United States Patent [19]

Spicer et al.

[11] 4,268,215

[45] May 19, 1981

[54] AIR SHIFTING DEVICE

[76] Inventors: Martin J. Spicer, 430 Union St.; Howard G. Spicer, 392 E. Bluff St., both of Marseilles, Ill. 61341

[21] Appl. No.: 9,959

[22] Filed: Feb. 6, 1979

[51] Int. Cl.[3] ..... E02F 3/85

[52] U.S. Cl. ..... 414/715; 74/491; 137/637

[58] Field of Search ..... 414/715, 697; 180/6.48; 137/594, 637 X; 74/473, 491, 879

[56] References Cited

U.S. PATENT DOCUMENTS

| | | | |
|---|---|---|---|
| 2,445,716 | 7/1948 | Sternberg | 74/745 |
| 3,388,821 | 6/1968 | White | 414/715 |
| 3,863,518 | 2/1975 | Webber et al. | 74/340 |

*Primary Examiner*—Leslie J. Paperner
*Attorney, Agent, or Firm*—Harvey B. Jacobson

[57] ABSTRACT

Two rotary air valves are mounted on the bucket control levers of an end loader and are operable to control the shifting of the loader's transmission. One of the air valves is used to operate a cylinder connected to the forward and reverse shift valves of the end loader power shift transmission while the other rotary air valve operates a pneumatic cylinder connected to the range selector valves of the power shift transmission. In this manner, both the bucket control functions as well as the forward and reverse movement of the end loader may be totally controlled by one hand of the operator leaving the other hand free to remain on the steering wheel at all times.

11 Claims, 4 Drawing Figures

AIR SHIFTING DEVICE

BACKGROUND OF THE INVENTION

1. Field of the Invention

This invention relates to the use of air pressure to perform the shifting functions in a power shift transmission, as well as combining the air shift valves with existing control levers for facilitating the operation of a front end loader.

2. Description of the Prior Art

In the standard modern day end loader, the common practice is to provide one pair of control levers for controlling the vertical and tilt operations of the bucket of the end loader, and one pair of control levers for forward reverse and range select controls for the power shift transmission of the end loader. The bucket controls are normally arranged for operation by one of the operator's hands while the transmission control levers are placed in proximity to the operator's opposite hand. Consequently, when need arises for controlling the forward or reverse motion of the machine while at the same time operating the bucket controls, the operator must remove both hands from the steering wheel of the machine, thus causing a potentially hazardous situation to arise. Furthermore, the ordinary transmission control consists of mechanical linkage elements which may become worn and loose, thereby causing a potential for missed shifts due to the linkage control lever not being moved to its limits by the operator. Accordingly, a need has arisen for a simple, safe and effective means of providing a compact control arrangement for end loaders which will obviate the above discussed deficiencies.

There are many known control arrangements for shifting transmissions and the like. Included among these is U.S. Pat. No. 2,445,716, issued Jul. 20, 1948, to Sternberg. The Sternberg device relates to truck transmissions utilizing a main transmission operated from a control lever and an auxiliary transmission operated from a rotary, finger operated lever mounted on the main control lever. U.S. Pat. No. 2,543,927, issued Mar. 6, 1951, to Montgomery, shows a gear shifting mechanism for a motorboat drive system. The Montgomery device includes a lever operating a cable which shifts a control valve which operate the slave cylinder to effect shifting of the transmission. U.S. Pat. No. 2,931,237, issued Apr. 5, 1960, to Backus, shows a gate-type remotely mounted shifting console and which has mounted thereon control valves for operating a pair of normally oriented slave cylinders for shifting a transmission. U.S. Pat. No. 3,863 518, issued Feb. 4, 1975, to Webber et al, shows an air operated transmission shifting system which includes neutraling means for automatically disengaging the vehicle drive line in the event of system malfunction.

SUMMARY OF THE INVENTION

The present invention provides a convenient, compact arrangement for providing operator control of the lift and tilt functions of an end loader bucket, as well as transmission control of the end loader by one hand of the operator. The system includes attaching a rotary air valve to each of the bucket lever controls in the cab of the end loader. Each rotary valve is connected through appropriate air lines to a self-centering air actuated cylinder. One cylinder is connected to the transmission forward reverse valving mechanism while the other cylinder is attached to the transmission range selector valve. A shifting knob is attached to the top of each of the rotary valves. In this manner, with the bucket control levers proximate one another, the end loader operator can conveniently control the bucket operation through manipulation of the levers and at the same time control the operation of the transmission by finger manipulation of the rotary valves. The use of self-centering cylinders enables a safety factor to be present in that the transmission will automatically be placed in neutral whenever the air pressure falls below the minimum needed for actuation of the cylinder.

Accordingly, one object of the present invention is to provide a shifting mechanism for power shift transmissions which will eliminate all mechanical linkage and levers thereby eliminating the possibility of missed shifts due to old, worn shift linkages.

A further object of the present invention is to provide a shifting mechanism for the power transmission on an end loader which can be incorporated for use with the bucket control levers of the end loader such that the operator can control both the bucket functions and transmission functions with a single hand leaving his opposite hand free to control the steering of the vehicle.

Yet a still further object of the present invention is to provide a shifting mechanism for power shift transmissions which is capable of utilizing the air pressure system presently available on the machine for operation of the brakes.

Another object of the present invention is to provide a shifting mechanism for power shift transmissions which incorporates a safety feature in that a self-centering cylinder is used for controlling the forward reverse function of the transmission in order that the transmission will remain in neutral until the operating air pressure reaches the minimum necessary for proper functioning of the brakes and shifting mechanism of the vehicle.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Now with reference to the drawings, the air shifting device of the present invention will be set forth in detail.

Figure 1:
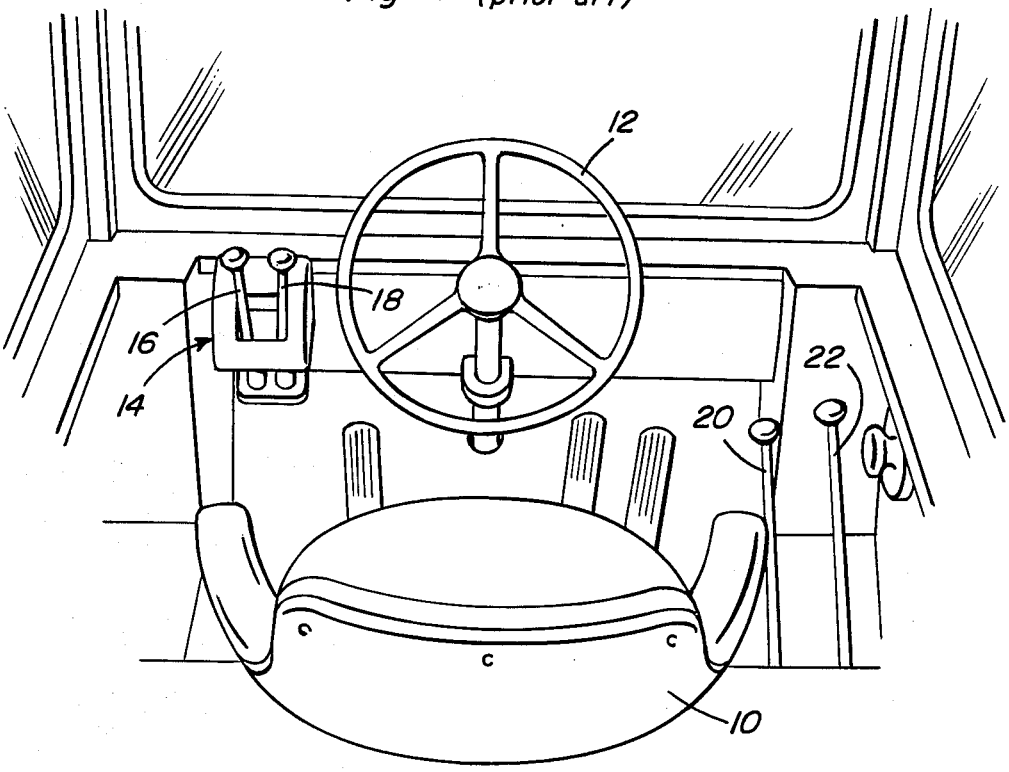
Fig. 1 (prior art)
FIG. 1 is a perspective view of the prior art control arrangement presently used in end loaders.

Initially, reference is directed to FIG. 1 which depicts the prior art arrangement of the control levers in the cab of an end loader. In FIG. 1, it can be seen that a standard operator's seat 10 is provided, as well as a steering wheel 12 for controlling the direction of travel of the vehicle. Also to the left of steering wheel 12 is control arrangement 14 which is attached to the power shift transmission of the vehicle through appropriate mechanical linkages. Control arrangement 14 includes range selector lever 16, which controls the gear ratio of the power shift transmission, and forward reverse lever 18, which is effective to place the transmission in either the forward, reverse, or neutral mode of operation. Also shown in FIG. 1 to the right of steering wheel 12 is a pair of bucket control levers 20 and 22. Lever 20 controls the bucket tilt operation of the end loader, while lever 22 controls the bucket hoist operation of the end loader. By examination of the placement of the control levers, as shown in FIG. 1, it will be readily apparent that for the vehicle operator to provide bucket movement, as well as properly controlled shifting of the end loader, it would be necessary for him to use his right hand for the bucket control operation and his left hand for the transmission control, thus leaving the steering wheel 12 free of positive operator control. This could create a hazardous situation since for proper operation of the vehicle, direct control of the steering wheel should be maintained at all times. Alternatively, proper, safe operation of the vehicle can be attained by interrupting the smooth operation of the end loader as the vehicle operator quickly shifts his hands from the steering wheel 12 to controls 14 and back to steering wheel 12 and then to controls 20 and 22. This provides a time-consuming operation and reduces the efficiency of the over-all vehicle motion.

Figure 2:
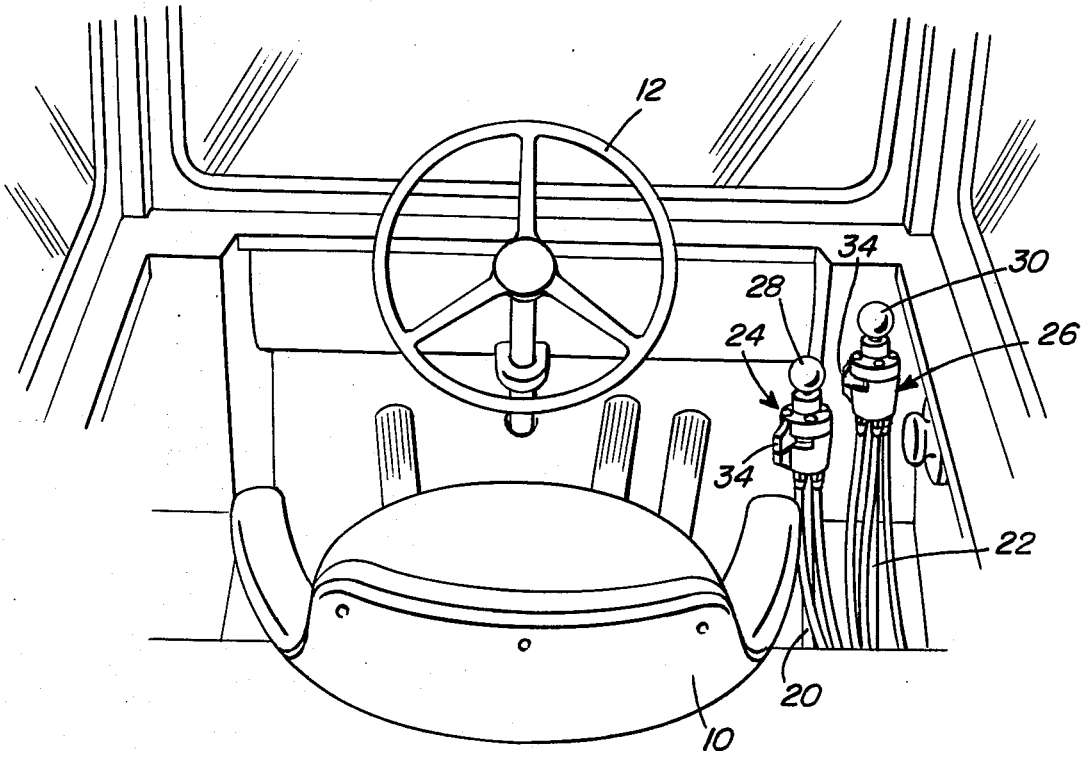
FIG. 2 is a perspective view of the control arrangement incorporating the present invention.
Figure 4:
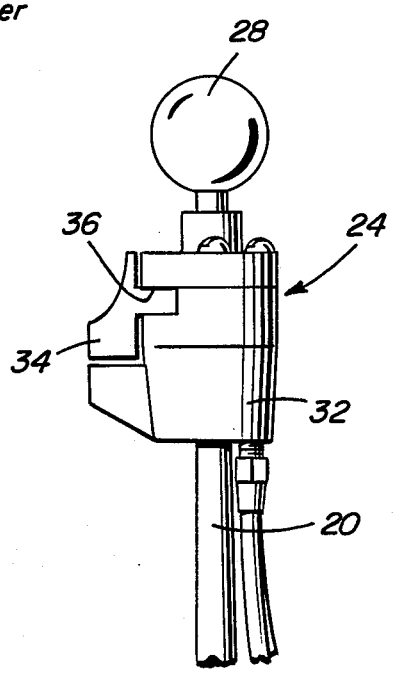
FIG. 4 is an elevational view of one rotary valve used in the present invention.

Now with reference to FIG. 2, it can be seen that the same basic cab configuration of FIG. 1, including the location of seat 10 and steering wheel 12, can be maintained with the shifting mechanism of the present invention incorporated in the vehicle. It will be noted that the transmission control arrangement 14 has been completely eliminated and in its place a pair of rotary actuatable air valves 24 and 26 have been included. Valve 24 controls the forward reverse operation of the vehicle power shift transmission, while valve 26 controls the range selector operation of the power shift transmission. Valve 24 is mounted upon the bucket control lever 20 and has mounted on top of it a shifting knob 28 to aid in controlling the movement of the lever 20. Valve 26 has a similar shifting knob, referred to by the numeral 30, mounted on top of it for controlling the movement of shifting lever 22. With reference to FIG. 4, an enlarged view of the valve 24 with surmounting knob 28 is shown in detail. Valves 24 and 26 are identical valves which are available from the Dana Corporation and are listed as part number 312490. Each of these valves includes a housing 32 from which extends actuation lever 34 which rotates about a portion of the valve periphery in slot 36. Valves 24 and 26 contain an inlet opening for connection to an air supply and two outlets, one each to the opposite ends of actuation cylinders, and an exhaust port. The lever 34 can take one of three positions, in the first position the inlet is connected to the first outlet and the second outlet is connected to the exhaust. In the middle position, both outlets are connected to the exhaust and in the third position, the inlet is connected to the second outlet and the first outlet is connected to the exhaust. As seen most clearly in FIG. 2 with reference to valve 26, three lines are connected to each valve. One line is for the inlet and the two other lines are for the two valve outlets. Again with reference to FIG. 4, it is quite clear that the operator can manipulate lever 20 by placing the palm of his hand upon knob 28 and at the same time his finger tips are free to manipulate lever 34. Furthermore, with levers 20 and 22 disposed in proximate relation to one another, the operator has access to all of the controls for the transmission and bucket of the end loader with one hand, leaving the other hand free to operate steering wheel 12.

Figure 3:
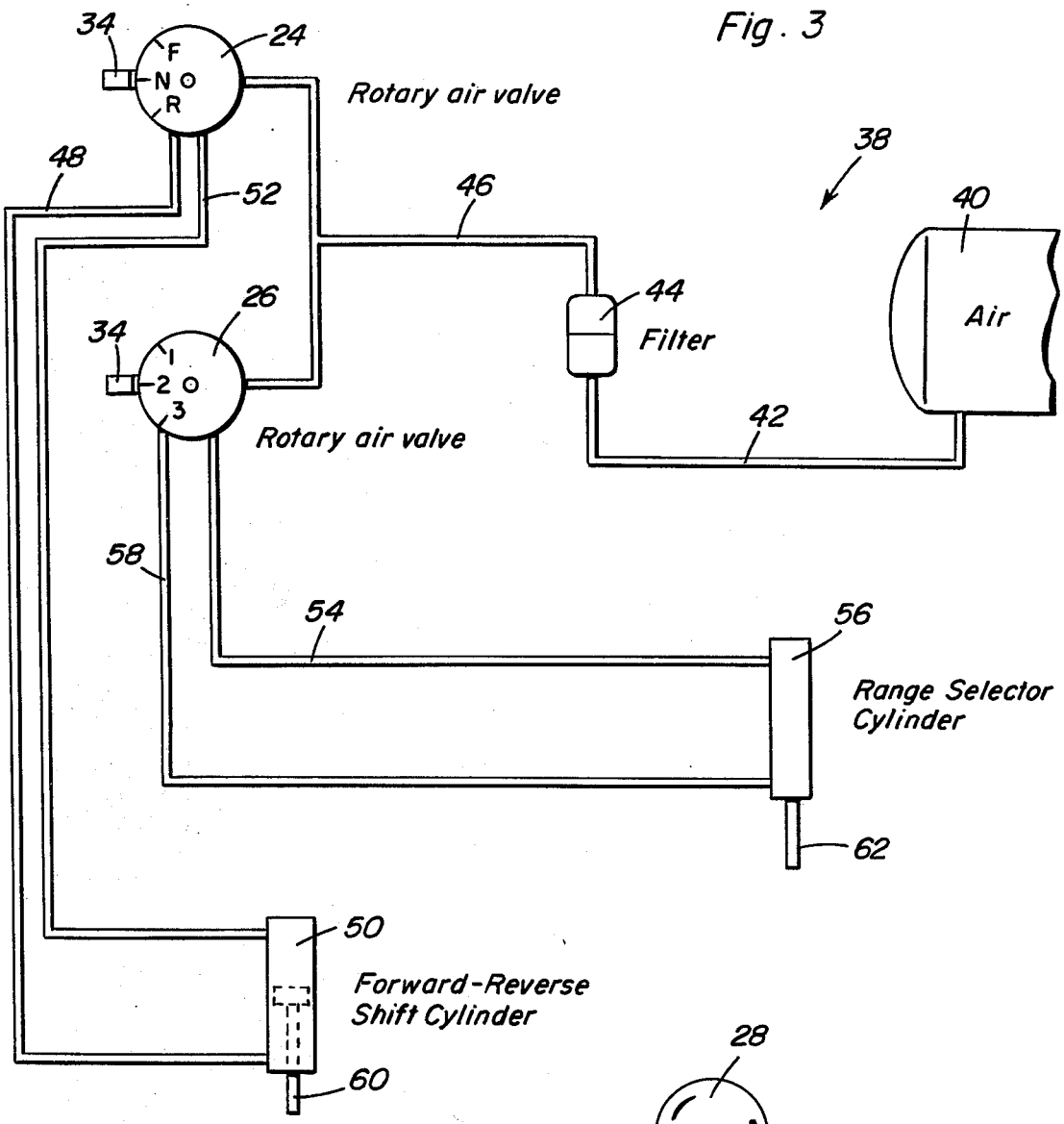
FIG. 3 is a schematic drawing of the air pressure control system of the present invention.

Now with reference to FIG. 3, the schematic diagram, generally referred to by the numeral 38, setting forth the operation of the air actuated gear shift mechanism will be described. An air supply tank 40 can be connected to the existing pneumatic brake air supply of the vehicle and tank 40 is connected through line 42 to filter regulator 44. The output of filter regulator 44 is line 46 which constitutes the input to valves 24 and 26. Valve 24 has a first output line 48 which is connected to the rear of forward reverse shift cylinder 50. A second output line 52 connects valve 24 to the forward end of cylinder 50. In like manner, a first output of valve 26, labeled 54, is connected to the rear of range selector cylinder 56 while the second output line of valve 26, designated 58, is connected to the forward end of cylinder 56. Cylinders 50 and 56 are standardly available self-centering pneumatic cylinders available from the Parker-Hannifan Corporation and designated as part number KD-027970. Cylinders 50 and 56 can be mounted directly on the power shift transmission of the end loader and pistons 60 and 62, respectively, of the cylinders can be connected directly to the appropriate transmission valves as would be readily apparent to those skilled in the art.

In operation, the pneumatic circuit 38 can produce forward, reverse and neutral shifting of the transmission through valve 24 and cylinder 50. With valve 24 in the central position marked "N", no pressurized air is transmitted to cylinder 50 and lines 48 and 52 are connected to an exhaust port. Piston 60 of cylinder 50 is therefore centered within the valve which constitutes the neutral position on the transmission. When lever 34 of valve 24 is rotated to the forward position marked "F", air is supplied to the upper line 52 forcing piston 60 to attain its fully extended position placing the transmission in the forward mode of operation. In like manner, when lever 34 is rotated to the third position on valve 24, marked "R", the output 52 is connected to supply 46 and the piston 60 attains its fully retracted position placing the transmission in the reverse mode of operation. The operation of valve 26 is exactly the same as that of valve 24. With the lever 34 of valve 26 placed in position 1, range selector cylinder 56 is fully extended placing the transmission in low gear. With the lever in position 2, the piston 62 obtains its center position placing the transmission in second gear. In like manner, with 34 in position 3, the piston is fully retracted placing the transmission in the third gear.

Accordingly, it can be seen that a complete kit constituting a pair of valves 24 and 26 together with cylinders 50 and 56 and the attendant air lines can be used to convert an end loader or like machinery from a cumbersome mechanical linkage to a conveniently disposed pneumatic shifting system which is capable of making the machine more efficient in use as well as providing an added safety factor by positioning all the machine controls in a convenient to reach location.

Other improvements and modifications of the system described hereinabove would include the use of a shift modulator wherein the modulator would be connected to valve 24 and would be effective for applying the brakes of the vehicle to insure that the vehicle was fully stopped when lever 34 of valve 24 passed through the neutral position. In this manner the transmission would be inhibited from being shifted from forward to reverse or from reverse to forward without the vehicle coming to a full stop first.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a vehicle utilizing a power shift transmission and including first and second auxiliary function control levers, the combination of: a first control means mounted on said first lever and connected to said transmission for causing said transmission to shift between gears, said first control means and said first lever being individually actuatable; and second control means mounted on said second lever for causing said transmission to shift between a forward and a reverse mode of operation, said second control means and said second lever being individually actuatable.

2. The combination of claim 1 wherein said first and second levers are located in close proximity to one another and further wherein said first and second control means are mounted in surmounting relation to their respective levers.

3. The combination of claim 2 and further wherein a first control knob is mounted on top of said first control means and a second control knob is mounted on top of said second control means.

4. The combination of claim 3 wherein said first control means comprises a first valve having a first actuation lever located in close proximity to said first control knob and said second control means constitutes a second valve having a second actuation lever located in close proximity to said second control knob.

5. The combination of claim 1 wherein said second control means constitutes a valve for controlling a fluid supply to a first fluid actuated cylinder, said fluid actuated cylinder being connected to a forward reversing shifting mechanism of said transmission, said first cylinder being a self-centering piston and cylinder arrangement, said arrangement taking on said centered disposition upon removal of fluid thereto so as to cause said transmission to assume its neutral position upon said piston taking on its centered position such that the transmission will automatically be placed in neutral upon the supply of said fluid falling below a minimum necessary to cause actuation of said first cylinder.

6. The combination of claim 5 wherein said first control means is a valve which controls a supply of fluid to a second actuation cylinder, said second actuation cylinder being connected to a range selector control of said transmission.

7. The combination of claim 6 wherein one of said first and second auxiliary control levers operates a tilt mechanism of a bucket on a front end loader and wherein another of said first and second auxiliary control levers operates a hoist mechanism of said bucket.

8. In an end loader vehicle having a power shift transmission and a hoistable and tiltable bucket, the combination of:

a first control lever for controlling a tilt angle of said bucket;

a second control lever for controlling hoisting of said bucket;

a compressed air supply means, said compressed air supply means serving in part to supply compressed air to a brake system of said vehicle so as to selectively operate the same;

a first rotary air valve being attachable to said first control lever whereby an operator of said vehicle can operate said first control lever and said first rotary air valve simultaneously with one hand, said first rotary air valve receiving a first supply of compressed air from an auxiliary conduit fluidly connected to said compressed air supply means;

a second rotary air valve being attachable to said second control lever whereby an operator of said vehicle can operate said second control lever and said second rotary air valve simultaneously with one hand, said second rotary air valve receiving a second supply of compressed air from said auxiliary conduit fluidly connected to said compressed air supply means;

a first self-centering piston and cylinder arrangement operable to control forward and reverse settings of said power shift transmission, said first self-centering piston and cylinder arrangement being operable in response to said first supply of compressed air being directed thereto by manual operation of said first rotary air valve; and a second self-centering piston and cylinder arrangement operable to control a plurality of gear speed settings of said power shift transmission, said second self-centering piston and cylinder arrangement being operable in response to said second supply of compressed air being directed thereto by manual operation of said second rotary air valve.

9. The combination of claim 8, and further including the provision of first, second and third air valve flow arrangements on said first rotary air valve, said first, second and third air valve flow arrangements corresponding respectively to selected positional movements of said first rotary air valve by said operator, said first air valve flow arrangement directing said first supply of compressed air to a first side of said first self-centering piston and cylinder arrangement so as to place said power shift transmission in a forward drive setting, said second air valve flow arrangement shutting off said first supply of compressed air to said first self-centering piston and cylinder arrangement so as to permit a centering of said first self-centering piston therein and an attendant placing of said power shift transmission in a neutral, non-driving setting, and said third air valve flow arrangement directing said first supply of compressed air to a second side of said first self-centering piston and cylinder arrangement so as to place said power shift transmission in a reverse drive setting.

10. The combination of claim 9, and further including the provision of fourth, fifth and sixth air valve flow arrangements on said second rotary air valve, said fourth, fifth and sixth air valve flow arrangements corresponding respectively to selected positional movements of said second rotary air valve by said operator, said fourth air valve flow arrangement directing said second supply of compressed air to a first side of said second self-centering piston and cylinder arrangement so as to place said power shift transmission in a first drive gear setting, said fifth air valve flow arrangement shutting off said second supply of compressed air to said second self-centering piston and cylinder arrangement so as to permit a centering of said second self-centering piston therein and an attendant placing of said power shift transmission in a second drive gear setting, and said sixth air valve flow arrangement directing said second supply of compressed air to a second side of said second self-centering piston and cylinder arrangement so as to place said power shift transmission in a third drive gear setting.

11. The combination of claim 10, and further including the provision of filter regulator fluidly positioned within said auxiliary compressed air conduit whereby said first and second supplies of compressed air provided respectively to said first and second rotary air valves is both regulated in pressure and cleaned by said filter regulator.

* * * * *